United States Patent [19]

Punako et al.

[11] 4,431,243

[45] Feb. 14, 1984

[54] CONTACT STOP FOR AN ELECTRICAL CONNECTOR

[75] Inventors: Stephen Punako; David W. Macavoy, both of Bainbridge; David O. Gallusser, Oneonta; David L. Frear, Afton, all of N.Y.

[73] Assignee: The Bendix Corporation, Southfield, Mich.

[21] Appl. No.: 402,525

[22] Filed: Jul. 28, 1982

[51] Int. Cl.[3] ..... H01R 13/40

[52] U.S. Cl. ..... 339/59 M

[58] Field of Search ..... 339/59 R, 59 M, 217 R, 339/217 S

[56] References Cited

U.S. PATENT DOCUMENTS 2,760,172 8/1956 Anderson ..... 339/59 M
3,101,229 8/1963 Yopp ..... 339/59 M
3,165,369 1/1965 Maston ..... 339/59
3,221,292 11/1965 Swanson et al. ..... 339/217

*Primary Examiner*—Joseph H. McGlynn
*Attorney, Agent, or Firm*—Raymond J. Eifler; Charles D. Lacina

[57] ABSTRACT

This invention provides a contact stop for an electrical connector of the type having front insertable contacts. The invention is characterized by a plate (40) of hard dielectric material located adjacent the rear face of a contact retaining insert (30). The plate (40) has a plurality of passages (41) each of which terminate at one end in a forwardly extending solid wall tubular tower (42) which has a forward end or a shoulder (43) which abuts against a rearwardly facing shoulder (23) on a contact (20) in the passage (31) of the insert (30) to limit rearward movement of the contact after it has been inserted into the insert (30).

3 Claims, 3 Drawing Figures

CONTACT STOP FOR AN ELECTRICAL CONNECTOR

This invention relates to an electrical connector and more particularly to a plate in the rear of the connector that stops the rearward movement of a contact inserted from the front of the connector.

Electrical connectors generally include a plug and receptacle, each of which has an insert of dielectric material provided with multiple openings within which electrical contacts are retained. The insert is introduced into the rear end of a metal shell or housing of the connector where it is held in place by some means such as a nut. Some connectors provide for rearward insertion and front or rear release of electrical contacts while other connectors provide for front insertion and front or rear release of electrical contacts. These features are desirable and facilitate the assembly and servicing of the connector. Examples of prior art electrical connectors having insertable and removable contacts may be found in U.S. Pat. Nos. 3,165,369 entitled "Retention System for Electrical Contacts" issued July 12, 1966, and 3,221,292 entitled "Electrical Connectors" issued Nov. 30, 1965. In the foregoing patents, the contacts are retained within the connector housing by a retention mechanism in a dielectric insert and the contacts are sealed from moisture by a separate rubber grommet which fits tightly around the incoming wires to prevent moisture from entering into the area between the contacts. In the foregoing types of connector, splaying of a contact may occur when the contact is subject to forces such as during mating. Splaying, or movement of the contact from its original axial position is undesirable because it may prevent mating with its counterpart contact in another housing. Further, the retention mechanism and some types of connectors may not be strong enough to provide the additional and necessary strength to prevent further rearward movement after the contact is retained in an insert. In connectors where an additional back plate is added as a stop to prevent further movement of a contact an alignment fixture is necessary during assembly of the connector to align the passages in the back plate with the passages in the contact retaining insert.

DISCLOSURE OF THE INVENTION

This invention provides a contact stop plate for an electrical connector of the type having front insertable contacts. The invention is characterized by a plate of hard dielectric material located adjacent the rear face of the insert containing the contacts. The plate has a plurality of passages each of which terminate at one end in a forwardly extending solid wall tubular tower which abuts against a rearwardly facing shoulder on a contact to limit rearward movement of the contact after insertion of the contact into the connector insert.

Accordingly it is an advantage of this invention to provide an improved contact stop for an electrical connector.

It is another advantage of this invention to provide a contact stop plate that does not require the use of special fixtures during assembly to align the passages in the plate with the passages in an insert.

It is another advantage of this invention to provide a contact stop plate that provides radial support for contacts mounted in the connector insert so that the contacts do not move radially when subject to a force during mating.

DETAILED DESCRIPTION OF THE INVENTION

Figure 1:
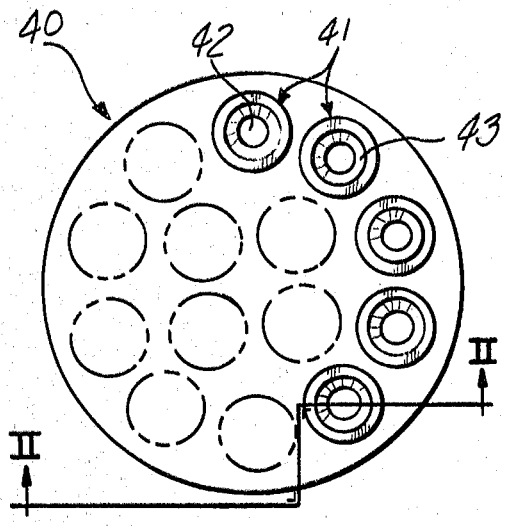
FIG. 1 illustrates a contact stop plate for an electrical connector incorporating the principles of this invention.

Referring now to the Drawings, FIG. 1 illustrates a plate 40 comprised of a hard dielectric material such as a 50% glass filled polyamide (nylon). The plate 40 includes a plurality of towers 41 each having a passage 42 therein that terminates in a shoulder 43 that is angled inwardly towards the central axis of the passage 42.

Figure 2:
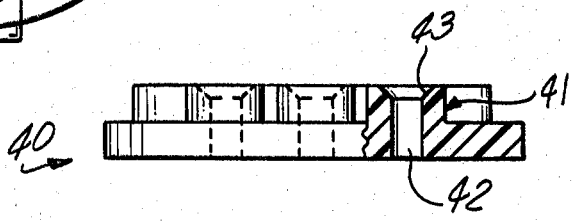
FIG. 2 illustrates a segment of the contact stop shown in FIG. 1 taken along lines II—II.

FIG. 2 is a cross-section of a portion of the contact stop plate 40 that illustrates the angled shoulder 43 which is adapted to mate with a complementary angled shoulder on a contact (not shown).

Figure 3:
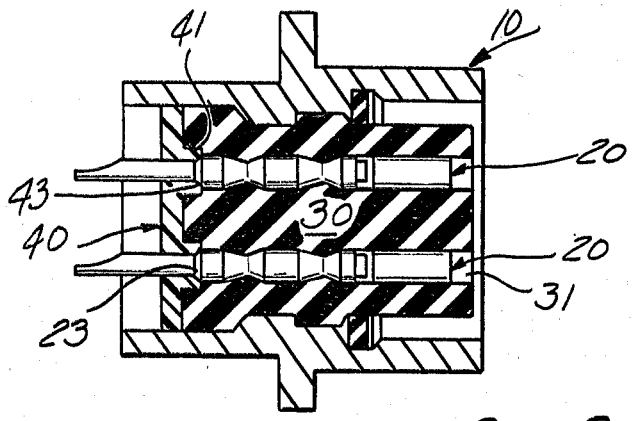
FIG. 3 illustrates an electrical connector incorporating the principles of this invention.

FIG. 3 is a diagrammatic view of an electrical connector assembly of the type having a metal shell or housing 10; an insert of the dielectric materials such as rubber 30 having a plurality of passages 31; electrical contacts 20 mounted in a portion of a respective passages 31 of the insert 30; and the plate 40 that stops further rearward movement of a contact 20 after it is inserted into a passage 31 from the front of the insert 30. The angled shoulders 43 in the forwardly extending towers 41 mate with the rearwardly facing angled shoulders 23 of respective contacts 20 to prevent rearward movement of a contact 20 once it is located and retained in the connector insert 30. The towers 41, located in respective recesses in the insert 30, provide support along a portion of a contact 20, thereby providing additional radial support to help prevent a contact from moving radially from its original position during the mating of a contact with a contact in another connector housing. The angled shoulder 43 also assists in aligning the contact 20 when it is inserted into the bore 31 in the insert 30.

While a preferred embodiment of the invention has been disclosed it will be apparent to those skilled in the art that changes may be made to the invention as set forth in the appended claims and, in some instances, certain features of the invention may be used to advantage without corresponding use of other features. Accordingly, it is intended that the illustrative and descriptive materials herein be used to limit the principles of the invention and not to limit the scope thereof.

Having described the invention what is claimed is:

1. In combination with an electrical connector of the type having: a housing having a forward portion and a rearward portion; a plurality of elongated contacts each having a forward mating portion an intermediate portion and a rear portion, said rear portion including a rearwardly facing shoulder; and means for releasably mounting each of said contacts in said housing including an insert having a plurality of bores therein, each of said contacts insertable from the front of said housing into a respective bore so that each bore has a portion of a respective contact mounted therein; the improvement comprising:

a member, comprised of a hard dielectric material, located adjacent the rear face of said insert, said member having a plurality of passages therein, each passage terminating at one end in a forwardly extending solid wall tubular tower, each of said towers having a forward end which abuts against a respective rearwardly facing shoulder on said contact whereby rearward movement of a contact in a passage is stopped by contact with the end of a tower.

2. The combination as recited in claim 1 wherein the rear portion of said insert includes a recess at the end of each passage, each recess having a respective tower of said members located therein.

3. The combination as recited in claim 1 or 2 wherein the forward end of the tower includes an angled shoulder that assists in algning the contact in the bore of the insert.

* * * * *